US005182139A

United States Patent [19]

Frankel et al.

[11] Patent Number: 5,182,139

[45] Date of Patent: Jan. 26, 1993

[54] ULTRASONIC REALTIME DETERMINATION AND DISPLAY OF THICKNESS OF CHROMIUM ON GUN BARRELS

[75] Inventors: Julius Frankel, Rensselaer; Mark Doxbeck, Troy, both of N.Y.

[73] Assignee: The United States of America as represented by the Secretary of the Army, Washington, D.C.

[21] Appl. No.: 760,636

[22] Filed: Sep. 16, 1991

[51] Int. Cl.[5] ..... B05D 3/12; B05D 7/22

[52] U.S. Cl. ..... 427/9; 427/239; 427/600; 427/560

[58] Field of Search ..... 427/57, 8, 9, 10, 239

[56] References Cited

U.S. PATENT DOCUMENTS 4,174,410 11/1979 Smith ..... 427/57
4,620,984 11/1986 Hoddinott ..... 427/9
4,702,931 10/1989 Falcoff ..... 427/10
4,800,104 1/1989 Cruickshank ..... 427/9

*Primary Examiner*—Marianne Padgett
*Attorney, Agent, or Firm*—Anthony, T. Lane; Edward Goldberg; Michael C. Sachs

[57] ABSTRACT

A method for measuring the plating on the inside of a gun barrel, including the steps of providing ultrasonic pulses against a gun barrel to be plated, and plating the inside while monitoring the echoes from said waves from the inside and outside diameters of the barrel with a plurality of transducers aligned to reflect ultrasound waves from the outside and the inside surfaces of the gun barrel. Change in time for the return of waves from the inside surface indicates the change in thickness of plating on the inside of the barrel. The change is calculated by measuring the change in time for the wave to return to its source, and multiplying by the sound velocity.

2 Claims, 1 Drawing Sheet

ULTRASONIC REALTIME DETERMINATION AND DISPLAY OF THICKNESS OF CHROMIUM ON GUN BARRELS

The invention described herein may be made, used, or licensed by or for the Government for Governmental purposes without the payment to me of any royalties thereon or therefor.

FIELD OF THE INVENTION

The present invention relates to plating tubing such as gun barrels and more particularly to the use of ultrasonic methods to measure and display the thickness of plating such as chromium during the plating process.

BACKGROUND OF THE INVENTION

During chromium electroplating of the inside diameter of gun barrels, the plater aims for a predetermined plate thickness and uniformity. The plater has a certain degree of experience, which tells him or her that if he or she runs the plating process for an hour with certain plating parameters on a given barrel, a certain chromium plate thickness will be achieved.

The prior art process is essentially blind, inasmuch as the thickness and evenness of the plate being formed is not available to the plater during the plating process. If the parameters which affect plating, such as surface passivation, concentration of solutes in the electrolyte, temperature, symmetrical placement of the anode in the bore, or flow rate of the electrolyte in the flowthrough plating process, combine to give any undesirable plating conditions, the plating process will continue with these undesirable conditions. Because of its blind nature, the plating process continues to follow the precalculated parameters, and the unacceptable condition is only found after a three hour plating run, for example, after the tube has been rinsed and dried. Perhaps, additional personnel or equipment will need to be called to evaluate the condition of the product.

Of course, up to now thick barrels were plated without measuring the thickness of the deposited chromium or other metal. No known process or method exists at this time to determine the plating thickness in real time.

The measuring methods for the plated thickness at the present time are done manually, such as by use of a star or an air gage. The method for correcting the problem, if the plate was not acceptable, was to strip the plated metal by a reverse plating method. Honing was also used. The tube was then replated via the same method described above.

Prior art methods for correcting the plating thickness such as in gun barrels have resulted in increased expenditure of manpower and resources. They cause delay and duplication of work, and slow down production schedules, thereby interrupting other parts of the production process.

Accordingly, it is an object of this invention to provide a method of determining the thickness of plating as it is being deposited on a surface.

Yet another object of this invention is to provide a real time measuring method which is capable of displaying the measurements being made, at various points in the tube.

Another object of the present invention is to provide a real time method for plating in which corrections and conditions can be redily implemented to keep production schedules and prevent duplication of work.

Other objects will appear hereinafter.

SUMMARY OF THE INVENTION

It has now been discovered that the above and other objects of the present invention may be accomplished in the following manner. It has been discovered that new results and advantages may be achieved using an ultrasonic pulse-echo technique in the plating of thick barrels. The method of this invention requires that the thickness of the substrate be much greater than the wavelength of the ultrasonic pulse. This process obtains graphic displays on a computer screen during the operation of the process. The displayed thickness data can be used in real time as a process control parameter or as information for manual control of the plating variables.

Specifically, the invention comprises the use of ultrasonic transducers to measure the plating thickness as it is deposited on the surface, and to provide a readout of that thickness. The operator of the plating process then can adjust the process as necessary, either automatically or manually.

The method comprises the steps of providing a plurality of ultrasonic pulse-echo transducers with frequencies having wavelengths much smaller than the thickness of the substrate, and processing the resulting signal to determine the real time increase or decrease in thickness of the plating on the substrate. It is admirably suited for use in the low contraction chromium plating method, using a flow-through process, particularly since the outer barrel surface is available for locating the transducers and because the temperature of the outside of the barrel can be stable within a band of 20° F.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Under well controlled conditions, ultrasonic technology provides a means of providing very accurate thickness measurements. The method, if one of two parallel surfaces of a thick (relative to the sound wavelength) piece to be measured is available for transducer application, is the pulse-echo technique. In this method, an ultrasonic transducer is applied to one of the parallel surfaces. When it is connected to the appropriate pulser, receiver and time measuring device, the time for the passage of a sound wave (the echo) can be obtained, and from the velocity of sound for the piece, its thickness can be determined.

Figure 1:
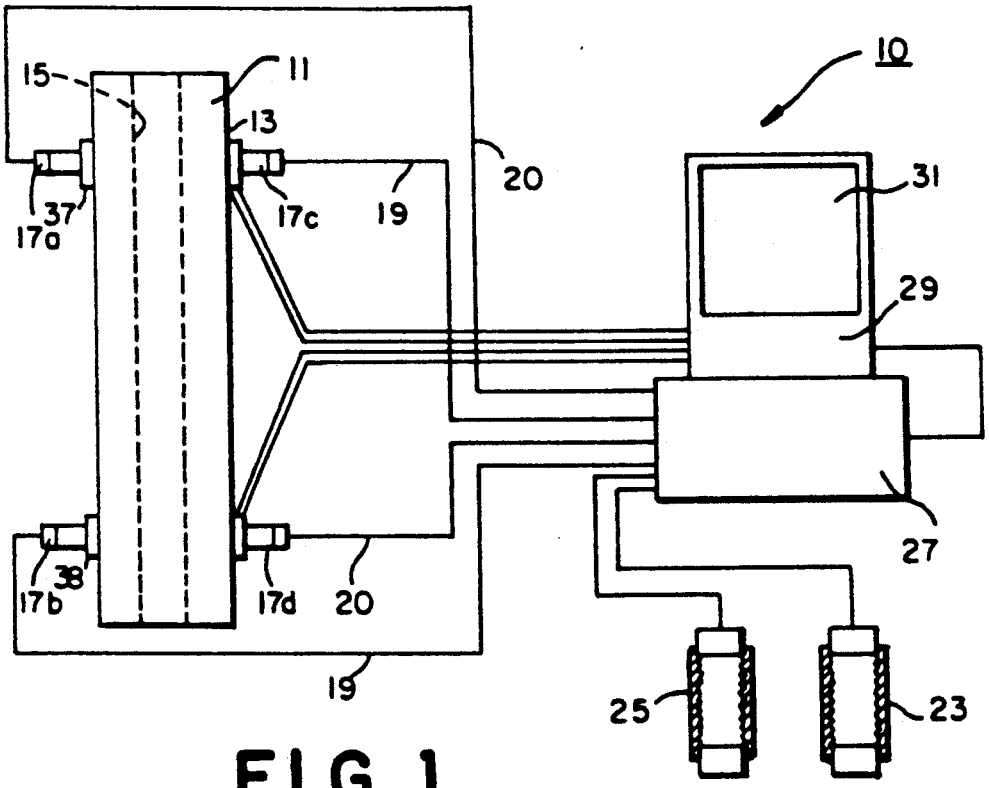
FIG. 1 is a schematic view of the system of the present invention, for use with a plating apparatus.

The conditions encountered during the plating of LC chromium in barrels by the flow-through method is illustrated in FIG. 1. This process is admirably suited for use with the method of this invention, although it is clear from a reading of this invention that the method of this invention may be applied to many other plating processes. Reference is made to LC chromium plating because it is easy to understand and clearly demonstrates the usefulness of the present invention.

As shown in FIG. 1, the system generally 10 includes a gun barrel 11, having an outside surface 13 and an inside surface 15. Shown attached in this Figure are only four pulse-echo ultrasonic transducers 17*a*, 17*b*, 17*c* and 17*d*, which have an ultrasonic pulse feed 19 and thermocouple 20 for each transducer 17.

First standard 23 and second standard 25 are provided and each transducer 17*a*, 17*b*, 17*c* and 17*d*, as well as the transducers for the standards 23 and 25, is operably connected and controlled by the multiplexed ultrasonic gage 27. Gauge 27 interacts with computer 29, which also processes readings from the standards 23, 25 and the transducers 17*a*, 17*b*, 17*c* and 17*d*, and all the thermocouples. Computer 29 presents real time data on display screen 31 as desired.

The inside 15 and outside faces 13 of the barrel 11, corresponding to the inside and outside diameter, have portions which are either parallel or are sufficiently parallel so that distance measurements can be made using pulse-echo ultrasonics. The acoustic impedance of the barrel steel, which is the product of density and velocity, and of the chromium which is plated on the steel are sufficiently close so that there are no reflections of the sound wave off the chromium and steel interface. Thus, the ultrasonic wave travelling perpendicularly to the interface does not see the interface sufficiently to be reflected by the interface. Therefore the wave measures the total thickness of the chromium and the steel wall of the barrel.

In order to enhance the repeated use of the transducers described below, and to protect them from the higher temperatures seen during the plating process, as well as to electrically insulate the transducers from the barrel, each is mounted in a manner so that it does not touch the barrel.

Figure 2:
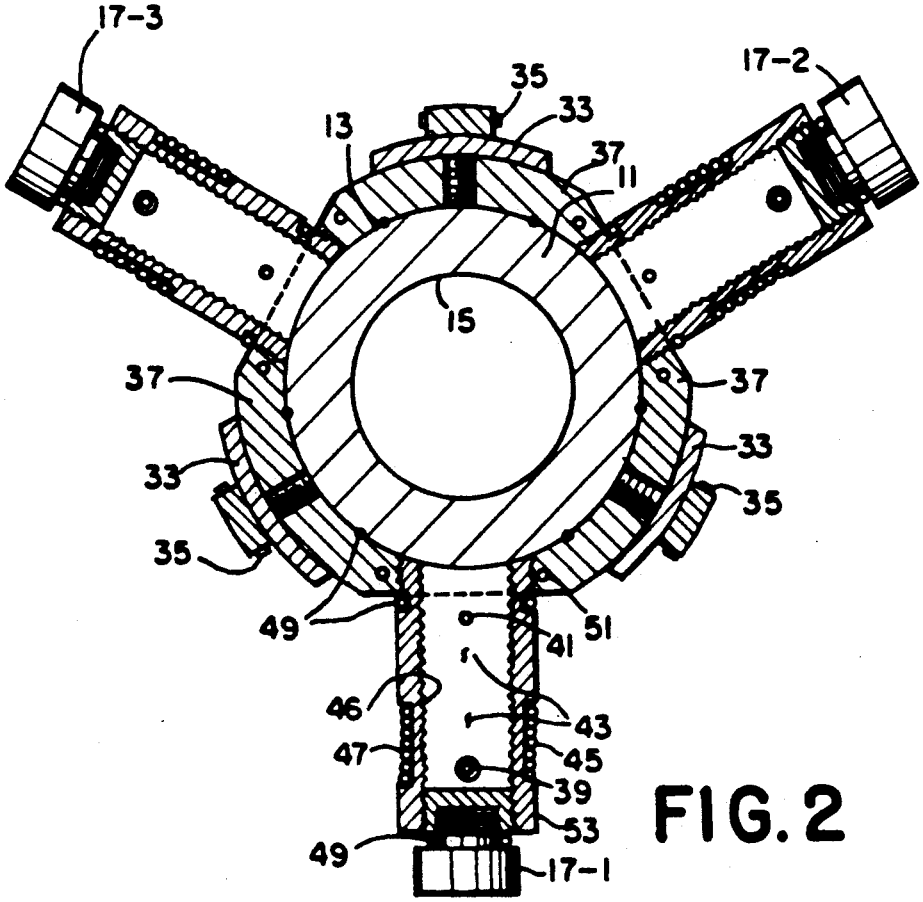
FIG. 2 is a schematic view of the preferred embodiment of the present invention, shown mounted on a gun barrel.

As shown in FIG. 2, barrel 11 has three transducers 17-1, 17-2, and 17-3 which are mounted on the outside 13 of barrel 11. Hose clamps 33 are tightened by screws 35 to hold metal saddle 37 on barrel surface 13. The saddle 37 cylinder 45 configuration protects the transducers from the temperature of the barrel which might reach or exceed 200° F. The three transducer 17-1, 17-2 and 17-3 are identical, and the description of transducer 17-1 which follows is applicable to all three.

All three transducers are focused and screwed into a plastic offset which is screwed into a metal cylinder 45. The plastic provides electrical insulation for the ultrasonic circuits from the plating circuits, and because it is hollow allows the transducer to transmit and receive the ultrasonic waves directly through the coupling medium. Cylinder 45 is hollow and about 2.5 inches long. The cylinder 45 has a threaded inside surface 46 to prevent reflections of the sound wave from the cylinder wall 46 back into transducer 17-1. The axis of cylinder 45 is along the radial direction for the circles formed by the outside 13 and inside 15 of barrel 11. The cylinder 45 is metal and is filled at fill hole 39 with a liquid mixture (such as water/ethanol) which acts to transmit sound waves 43, until the fluid comes out the breather hole 41. Various o-rings 49 are shown to trap the liquid.

Transducer 17-1 generates sound pulses 43 which travel from the transducer unit 17-1 in cylinder 45 to the gun barrel 11 and back. Transducer 17-1 receives two signals, one from the outside diameter 13 and one from the inside diameter 15 of barrel 11. These signals are both echoes, and the difference in the arrival time between them at the transducer is related to the thickness of the gun plus chromium combination and the sound velocity. As the thickness of the chromium on inside 15 increases, the time difference between the two echoes increases as well, and similarly the change in return time is related to the change in chromium thickness by the sound velocity in chromium.

Note that there is a set of three transducers at two locations along the barrel, so that chromium deposition and deposition rate can be monitored around the barrel and along its length. The cylinders 45 contain cooling coils 47, such as copper tubing so that tap water can be used for cooling the cylinder and the liquid to further protect the transducers from temperature degradation.

Sound velocity is temperature dependent and the thickness of the plating is known from a time measurement via a velocity. It is therefore important to know the temperature of the metal which the sound waves traverse. Monitoring the temperature is accomplished by thermocouple insertion holes 51 in all the saddles 37, located close to the point of insertion of the sound wave. Up to seven thermocouples are used in this embodiment to feed into the computer 29, as shown in FIG. 1.

All of the data from the transducers and thermocouples is stored and can be displayed either in raw form as voltages which are proportional to the time interval, or the data may be processed by a calibration system to display actual thickness, with or without temperature compensation. Inclusion of the temperature dependent velocity in the computer equation allows for temperature compensation.

Turning again to FIG. 1, tests were performed to demonstrate the use of the present invention. Presented herein are the results of some of these experiments and measurements. Thickness was measured by having the system continuously measure the thicknesses of two steel disks (the standards) which were 0.008 inches different in thickness. The two disks were hooked up to two different transducers via a water path.

Standard references 23 and 25 had initial voltages of 0.6400 and 0.6459 respectively over a 90 minute test, indicating stable conditions. Transducer 17*a* showed a change in voltage from an initial reading of 0.5934 to 0.5990, indicating a chromium thickness increase of 0.0076 inches for constant temperature. Transducer 17*b* showed a change in voltage from an initial reading of 0.5944 to 0.5999, indicating a chromium thickness increase of 0.0075 inches, also for constant temperature. Temperature of plating at 17*a* was 125.3° C. and 127.8° C. at 17*b*.

Historically, another method was used to measure the plating thickness, under circumstances where the total thickness of the plate and substrate are of the same order of magnitude as the wavelength of the sound. This method involves resonance of ultrasonic waves. When 5 MHz waves are used and the velocity of the sound is 5800 meters per second, the wavelength is about 0.00116 meters. The thickness of a barrel might be about 0.05 meters, which is a factor of 50 larger in size, and the resonance method does not work here. Lower frequencies, thereby increasing the wavelength, will lower the accuracy of readings.

At resonant frequencies, ultrasonic waves can interfere destructively with each other. Hence if a continuous sound wave is sent into the specimen, or a pulse whose pulse width is greater than the specimen thickness, then at resonant frequency, the output of these waves is zero. The condition for destructive interference is that the specimen thickness is $L = n * \text{Lambda}/2$, where Lambda is the wavelength. This gives the frequency at which destructive interference occurs as $f = n$

* v/2L, where v is the sound velocity and v/f=Lambda, and n is an integer.

In order to find the uncertainty in L, two successive minima or frequencies at which there is destructive interference are found, so that the difference in frequencies is calculated as follows. $dL/d(\text{Delta } f) = -2L^2/v$. For practical purposes, a gun tube with a wall thickness of 5 centimeters and a sound velocity of 5800 meters per second will give one ten thousandths of an inch per 2 cycles as the uncertainty. This means that whatever method used to determine the minimum frequency difference would have to be accurate to 2 cycles to obtain the same resolution as the first method described above. This is highly unlikely.

While particular embodiments of the present invention have been illustrated and described herein, it is not intended to limit the invention. Changes and modifications may be made therein without departing from the scope of the following claims.

We claim:

1. A method of plating an inner surface of a gun barrel, comprising the steps of:

providing ultrasonic pulse echo waves against said gun barrel to be plated; wherein at least three transducers are aligned radially and equidistantly from one another around an outside surface of said barrel, and a second set of at least three transducers are similarly aligned at a second axial location on the outside of said barrel, to reflect said waves from both the outside and the inner surfaces of said gun barrel; plating said inner surface while monitoring echoes made by the reflected waves;

calculating change in thickness by measuring change in time for said echoes to return to their source, whereby the change in time for the inside surface indicates the change in thickness of plating thereon.

2. A method of plating an inside surface of a gun barrel, comprising the steps of:

providing ultrasonic pulse echo waves against said barrel to be plated inside:

plating said inside surface while monitoring the echo from said waves with a pair of at least three transducers aligned to reflect said waves from outside and the inside surfaces of said gun barrel, wherein said first set of at least three transducers are aligned radially and equidistantly from one another around the outside of said barrel, and a second set of at least three transducers are similarly aligned at a second axial location on the outside of said barrel, whereby change in time for waves to reflect from the inside surface indicates change in thickness of plating thereon; and calculating the change in thickness by measuring the change in time for said wave to return to its source.

* * * * *